US011710451B2

(12) United States Patent
Lee

(10) Patent No.: US 11,710,451 B2
(45) Date of Patent: Jul. 25, 2023

(54) DISPLAY DEVICE AND METHOD FOR REDUCING IMAGE STICKING BY SHIFTING PIXELS

(71) Applicant: SAMSUNG DISPLAY CO., LTD., Yongin-si (KR)

(72) Inventor: Jungyu Lee, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/404,466

(22) Filed: Aug. 17, 2021

(65) Prior Publication Data

US 2022/0189392 A1 Jun. 16, 2022

(30) Foreign Application Priority Data

Dec. 14, 2020 (KR) ..... 10-2020-0174103

(51) Int. Cl.
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2320/046* (2013.01); *G09G 2360/16* (2013.01)

(58) Field of Classification Search
CPC ..... G09G 2320/046; G09G 2320/043
See application file for complete search history.

(56) References Cited

U.S. PATENT DOCUMENTS 8,855,414 B1 * 10/2014 Hobbs ..... H04N 19/12 382/166
10,923,009 B2 2/2021 Lee et al.
2005/0195280 A1 * 9/2005 Murakami ..... G09G 3/007 348/173
2014/0232409 A1 * 8/2014 Keum ..... G09G 3/3225 324/414
2015/0243199 A1 * 8/2015 Lee ..... G09G 3/3648 345/691

(Continued)

FOREIGN PATENT DOCUMENTS

CN 110875006 3/2020
CN 112837650 5/2021

(Continued)

*Primary Examiner* — Sepehr Azari
(74) *Attorney, Agent, or Firm* — F. Chau. & Associates, LLC

(57) ABSTRACT

A display device includes a display panel and a driver which receives image signals and transmits data signals to the display panel. The driver includes an image sticking compensator that converts the image signals such that the first image is periodically shifted while being displayed. The image sticking compensator includes an extractor which extracts compensation area data corresponding to a first image displayed in a compensation area, a calculator which calculates fixed data based on the compensation area data and corresponding to the first image, and a shifter which generates shift-fixed data based on the fixed data. The compensation area includes a first area in which the first image is displayed and a second area in which a peripheral image at least partially surrounding the first image is displayed.

12 Claims, 16 Drawing Sheets

(56) References Cited

U.S. PATENT DOCUMENTS

| | | | | |
|---|---|---|---|---|
| 2016/0086526 | A1* | 3/2016 | Kim | G09G 3/007 345/698 |
| 2016/0189336 | A1* | 6/2016 | Lee | G09G 3/007 345/589 |
| 2016/0253930 | A1* | 9/2016 | Lee | G09G 5/38 345/1.3 |
| 2020/0074596 | A1* | 3/2020 | Chun | G09G 3/2007 |
| 2020/0074708 | A1* | 3/2020 | Park | G06T 7/90 |
| 2020/0074906 | A1* | 3/2020 | Lee | G09G 3/20 |
| 2020/0082796 | A1* | 3/2020 | Chun | G09G 5/38 |
| 2021/0134199 | A1 | 5/2021 | Lee et al. | |

FOREIGN PATENT DOCUMENTS

| | | |
|---|---|---|
| EP | 3618042 | 3/2020 |
| EP | 3816980 | 5/2021 |
| JP | 2020038340 | 3/2020 |
| KR | 101182779 | 9/2012 |
| KR | 1020180013527 | 2/2018 |
| KR | 1020200026424 | 3/2020 |
| KR | 1020210054093 | 5/2021 |

* cited by examiner

DISPLAY DEVICE AND METHOD FOR REDUCING IMAGE STICKING BY SHIFTING PIXELS

CROSS-REFERENCE TO RELATED APPLICATIONS

This application claims priority under 35 U.S.C. § 119 to Korean Patent Application No. 10-2020-0174103, filed on Dec. 14, 2020 in the Korean Intellectual Property Office, the disclosure of which is incorporated by reference herein in its entirety.

TECHNICAL FIELD

Embodiments of the inventive concept relate to a display device and a method of driving the same. More particularly, embodiments of the inventive concept relate to a display device having improved display quality and a method of driving the display device.

DISCUSSION OF RELATED ART

Various types of display devices are used to provide image information. A display device may include a display panel that includes light-generating pixels and a driver which may be connected to the display panel and may apply a driving signal to the display panel. Display devices include organic light emitting display devices, liquid crystal display devices, plasma display devices, and the like.

A display device may display images by applying current and voltage signals to pixels in a display panel. When a specific image is displayed on the same pixels for an extended period of time, the image may "burn in" to the pixels, which may reduce an image quality of the display device.

SUMMARY

Embodiments of the inventive concept provide a display device configured to prevent a decrease in the quality of a displayed image due to pixel burn-in and image sticking, and a method of driving the same.

According to an embodiment of the inventive concept, a display device includes a display panel that includes a display area in which an image that includes a first image and a second image is displayed, and a driver which receives external image signals and transmits data signals to the display panel. The driver includes an image sticking compensator that converts the external image signals such that the first image is periodically shifted while being displayed. The image sticking compensator includes an extractor which extracts compensation area data corresponding to a compensation area of the display panel from the external image signals, a calculator which receives the compensation area data from the extractor and calculates fixed data based on the compensation area data, and a shifter which receives the fixed data from the calculator and generates shift-fixed data based on the fixed data. The compensation area includes a first area in which the first image is displayed and a second area in which a peripheral image included in the second image is displayed. The peripheral image at least partially surrounds the first image, and the fixed data corresponds to the first image.

In an embodiment, the image sticking compensator further includes a determiner that generates a determination signal based on the compensation area data, and the calculator calculates the fixed data in response to receiving the determination signal from the determiner.

In an embodiment, the determination signal includes a first determination signal and a second determination signal, the determiner generates the first determination signal when the first image includes a first sub-image corresponding to a letter and a second sub-image corresponding to a letter background image, and the determiner generates the second determination signal when the first image includes only the first sub-image.

In an embodiment, the calculator calculates the fixed data from the compensation area data based on the determination signal.

In an embodiment, the fixed data includes first fixed data and second fixed data. The calculator calculates the first fixed data from the compensation area data when receiving the first determination signal and calculates the second fixed data from the compensation area data when receiving the second determination signal. The first fixed data includes data corresponding to the first sub-image and data corresponding to a portion of second sub-image. The second fixed data includes the data corresponding to the first sub-image.

In an embodiment, the shifter receives an external predetermined set value and generates the shift-fixed data based on the set value and the fixed data, and the set value includes information corresponding to a shift path of the first image.

In an embodiment, the display panel includes a plurality of pixels, the shift path includes a first direction, and the shifter generates the shift-fixed data based on the fixed data to shift the first image in the first direction. The shift-fixed data are generated by scaling-up the fixed data such that the first image displayed in n pixels arranged in the first direction is displayed in m pixels arranged in the first direction and then scaling-down the scaled-up fixed data such that the first image displayed in the m pixels is displayed in the n pixels shifted in the first direction by m minus n pixels, where n and m are positive integers and m is greater than n.

In an embodiment, the shift path further includes a second direction crossing the first direction and the shifter generates the shift-fixed data based on the fixed data to shift the first image in the second direction. The shift-fixed data are generated by scaling-up the fixed data such that the first image displayed in j pixels arranged in the second direction is displayed in k pixels arranged in the second direction and then scaling-down the scaled-up fixed data such that the first image displayed in the k pixels is displayed in the j pixels shifted in the second direction by k minus j pixels, where j and k are positive integers and k is greater than j.

In an embodiment, the image sticking compensator further includes a converter that receives the shift-fixed data from the shifter and generates image data by converting the shift-fixed data, and the driver generates the data signals based on the image data.

In an embodiment, the driver includes a controller which receives the image signals and an external control signal, a source driver which receives the image data and the external control signal from the controller and transmits the data signals to the display panel, and a gate driver which receives the control signal from the controller and transmits a scan signal to the display panel. The controller includes the image sticking compensator.

According to an embodiment of the inventive concept, a method of driving a display device is provided. The method includes generating shift-fixed data such that a first image is periodically shifted while being displayed in a display area of a display panel included in the display device. The generating of the shift-fixed data includes receiving, by a driver included in the display device, external image signals, extracting compensation area data corresponding to a first image displayed in a compensation area of the display area from external image signals, calculating fixed data from the compensation area data, and generating the shift-fixed data based on the fixed data. The compensation area includes a first area in which the first image is displayed and a second area at least partially surrounding the first area in which a peripheral image at least partially surrounds the first image is displayed, and the fixed data corresponds to the first image.

In an embodiment, the generating of the shift-fixed data further includes generating a determination signal based on the compensation area data, and the fixed data is calculated based on the determination signal.

In an embodiment, the generating of the determination signal includes generating a first determination signal when the first image includes a first sub-image corresponding to a letter and a second sub-image corresponding to a letter background image, and generating a second determination signal when the first image includes only the first sub-image.

In an embodiment, the calculating of the fixed data is based on the determination signal.

In an embodiment, the fixed data includes first fixed data and second fixed data. The calculating of the fixed data includes calculating the first fixed data from the compensation area data based on the first determination signal and calculating the second fixed data from the compensation area data based on the second determination signal. The first fixed data includes data corresponding to the first sub-image and data corresponding to a portion of second sub-image. The second fixed data includes the data corresponding to the first sub-image.

In an embodiment, the generating of the shift-fixed data includes receiving an external predetermined set value and generating the shift-fixed data based on the external predetermined set value and the fixed data. The set value includes information corresponding to a shift path of the first image.

In an embodiment, the display panel includes a plurality of pixels, and the shift path includes a first direction. The generating of the shift-fixed data includes generating the shift-fixed data based on the fixed data to shift the first image in the first direction. The generating of the shift-fixed data to shift the first image in the first direction includes scaling up the fixed data such that the first image displayed in n pixels arranged in the first direction is displayed in m pixels arranged in the first direction and scaling down the scaled-up fixed data such that the first image displayed in the m pixels is displayed in the n pixels shifted in the first direction by m minus n pixels, where n and m are positive integers and m is greater than n.

In an embodiment, the shift path further includes a second direction crossing the first direction. The generating of the shift-fixed data further includes generating the shift-fixed data based on the fixed data to shift the first image in the second direction. The generating of the shift-fixed data to shift the first image in the second direction includes scaling up the fixed data such that the first image displayed in j pixels arranged in the second direction is displayed in k pixels arranged in the second direction and scaling down the scaled-up fixed data such that the first image displayed in the k pixels is displayed in the j pixels shifted in the second direction by k minus j pixels, where j and k are positive integers and k is greater than j.

In an embodiment, the method further includes receiving the shift-fixed data and generating image data by converting the shift-fixed data, generating data signals based on the image data, and transmitting the data signals by the driver to the display panel.

In an embodiment, the driver includes a controller receiving the image signals and an external control signal, a source driver receiving the image data and the external control signal from the controller and transmitting the data signals to the display panel, and a gate driver receiving the control signal from the controller and transmitting a scan signal to the display panel. The generating of the shift-fixed data is performed by the controller.

BRIEF DESCRIPTION OF THE DRAWINGS

The above and other features of the inventive concept will become more apparent by describing in detail embodiments thereof with reference to the accompanying drawings, in which.

DETAILED DESCRIPTION

Figure 1:
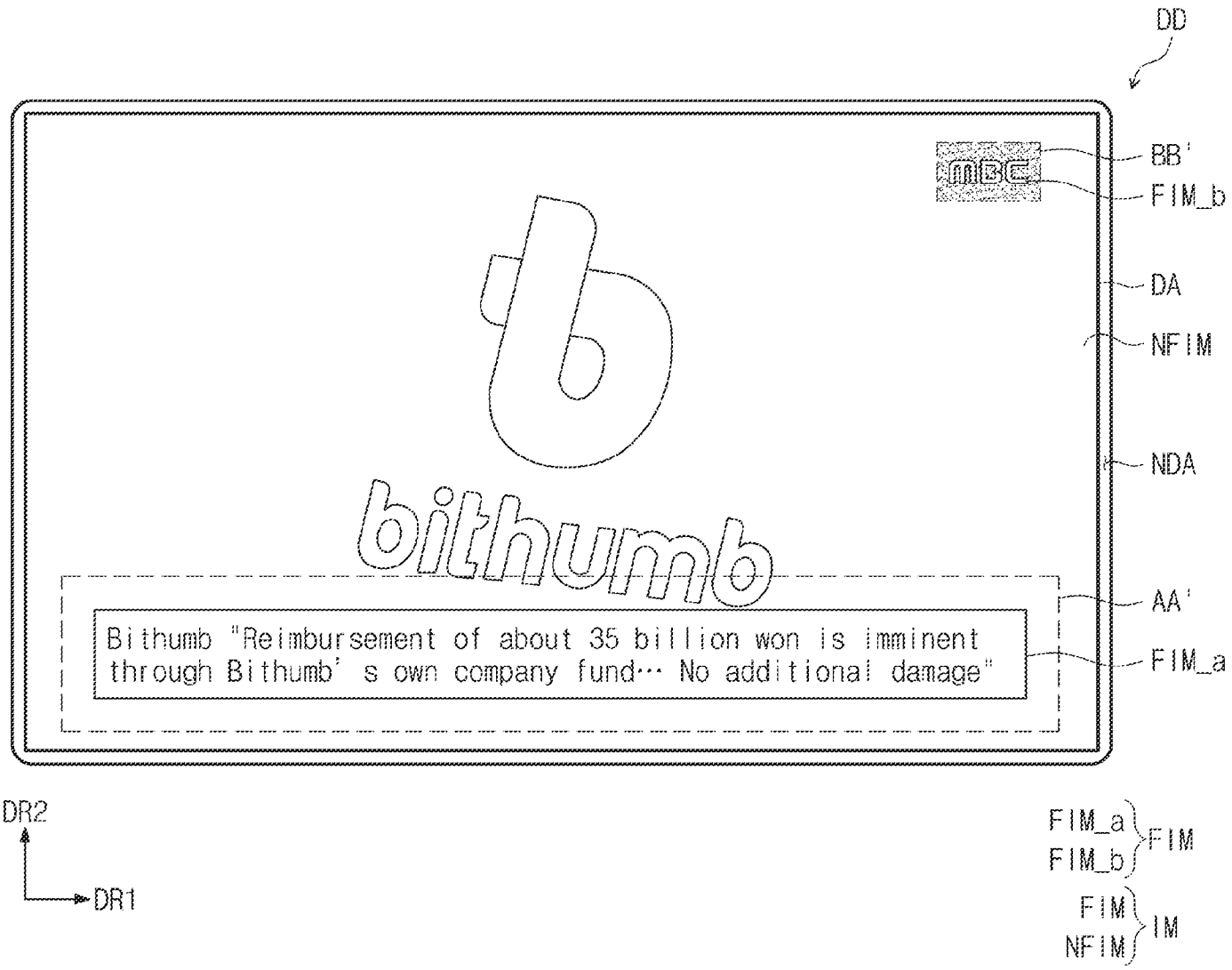
FIG. 1 is a plan view of a display device according to an embodiment of the inventive concept.

Embodiments of the inventive concept will be described more fully hereinafter with reference to the accompanying drawings. Like reference numerals may refer to like elements throughout the accompanying drawings.

As is traditional in the field of the inventive concept, embodiments are described and illustrated in the drawings in terms of functional blocks, units, and/or modules. Those skilled in the art will appreciate that these blocks, units, and/or modules may be physically implemented by electronic (or optical) circuits such as logic circuits, discrete components, microprocessors, hard-wired circuits, memory elements, wiring connections, etc.

It will be understood that when an element or layer is referred to as being "on", "connected to" or "coupled to" another element or layer, it may be directly on, connected or coupled to the other element or layer, or intervening elements or layers may be present.

Like numerals refer to like elements throughout.

As used herein, the term "and/or" includes any and all combinations of one or more of the associated listed items.

It will be understood that, although the terms first, second, etc. may be used herein to describe various elements, these elements should not be limited by these terms. These terms are only used to distinguish one element from another element. Thus, a first element discussed below could be termed a second element without departing from the teachings of the inventive concept. As used herein, the singular forms, "a", "an" and "the" are intended to include the plural forms as well, unless the context clearly indicates otherwise.

Spatially relative terms, such as "beneath", "below", "lower", "above", "upper", and the like may be used herein for ease of description to describe one element or feature's relationship to another element(s) or feature(s) as illustrated in the figures.

Figure 2:
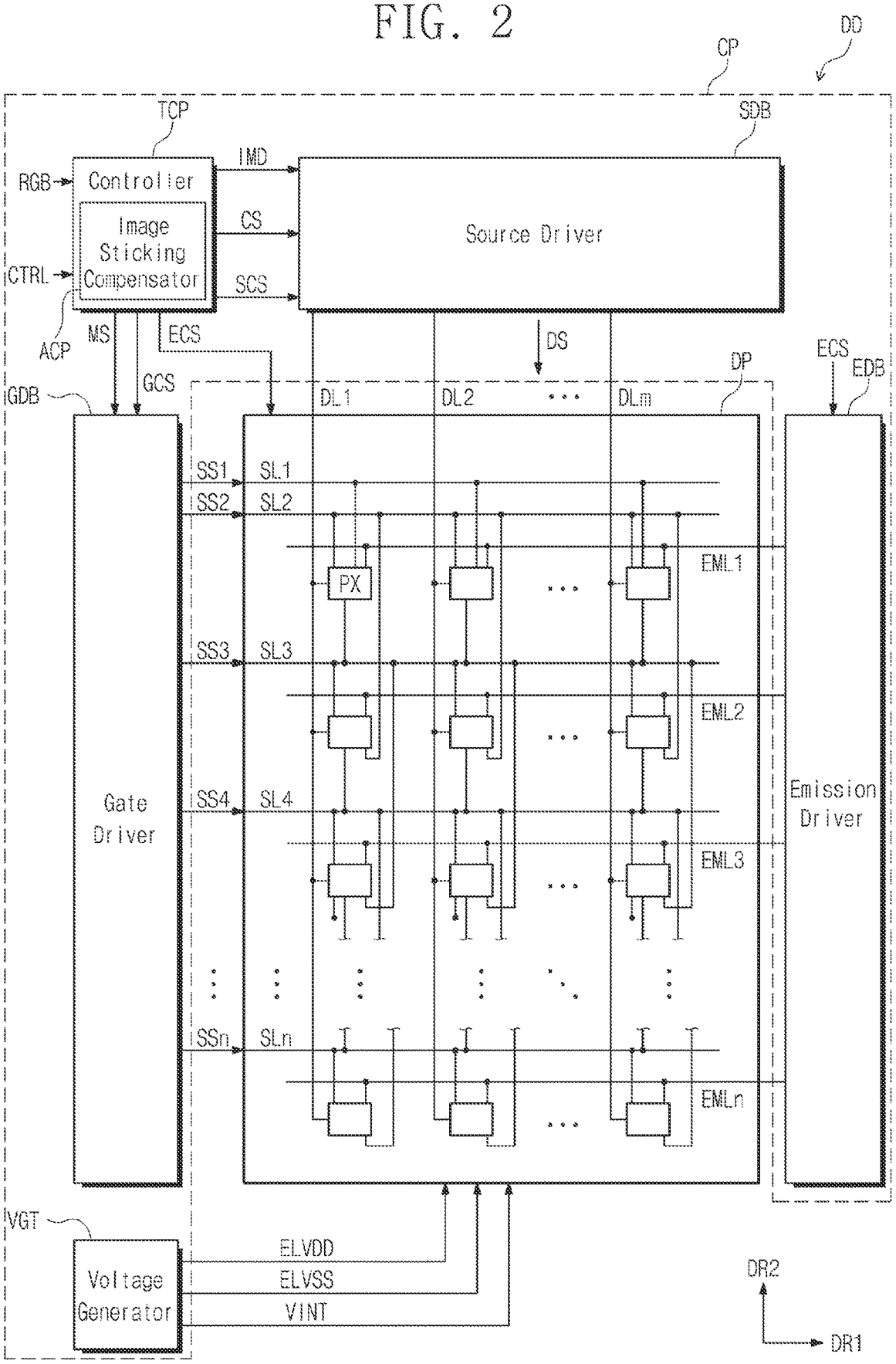
FIG. 2 is a block diagram of the display device according to an embodiment of the inventive concept.

FIG. 1 is a plan view of a display device DD according to an embodiment of the inventive concept, and FIG. 2 is a block diagram of the display device DD according to an embodiment of the inventive concept.

Referring to FIGS. 1 and 2, the display device DD may have a rectangular shape with long sides which may extend in a first direction DR1 and short sides which may extend in a second direction DR2 crossing the first direction DR1. The second direction DR2 may be substantially perpendicular to the first direction DR1. However, the shape of the display device DD is not limited thereto, and the display device DD may have a variety of shapes.

The display device DD may be a large-sized display device, such as a television set, a monitor, or the like, or a small-sized or medium-sized display device, such as a mobile phone, a tablet computer, a car navigation unit, a game unit, or the like. However, embodiments of the inventive concept are not limited thereto, and the display device DD may be employed in other electronic devices.

Referring to FIGS. 1 and 2, the display device DD may include a display panel DP which may display an image IM and a driver CP which may drive the display panel DP. As an example, the driver CP may include a controller TCP, a gate driver GDB, a source driver SDB, an emission driver EDB, and a voltage generator VGT.

The display panel DP may include a display area DA which may display the image IM and a non-display area NDA which may be provided adjacent to the display area DA. The display area DA may include a plurality of pixels PX, each of which may display at least a portion of the image IM, and the non-display area NDA may be a bezel area through which no image is displayed. FIG. 1 shows a structure in which the non-display area NDA surrounds the display area DA. However, embodiments of the inventive concept are not limited thereto. For example, the non-display area NDA may be provided adjacent to only one side of the display area DA.

The image IM may be displayed through the display area DA. The image IM may include a first image FIM and a second image NFIM. The first image FIM may be an image displayed by particular pixels of the plurality of pixels PX for a predetermined time or longer in a predetermined gray level. For example, the first image FIM may include at least one of a broadcaster logo, subtitles, date, time, and the like. For example, the first image FIM may include a title of a video. Hereinafter, for the convenience of explanation, various images which may be displayed at a fixed position for a predetermined time or longer in a specific gray level may be referred to as the first image FIM. Hereinafter, a first image FIM that includes subtitles will be referred to as a first fixed image FIM_a, and a first image FIM that includes a broadcaster logo will be referred to as a second fixed image FIM_b. However, embodiments of the inventive concept are not limited thereto. For example, the first fixed image FIM_a may include other first images in addition to subtitles, and the second fixed image FIM_b may include other first images in addition to a broadcaster logo. The first and second fixed images FIM_a and FIM_b will be further described later with reference to FIGS. 4A and 4B. The second image NFIM may be an image displayed through an area of the display area DA in which the first image FIM is not displayed.

The controller TCP may receive image signals RGB and an external control signal CTRL from an external source. The controller TCP may generate image data IMD by converting a data format of the image signals RGB to a format appropriate to an interface between the controller TCP and a source driver SDB. The controller TCP may generate a gate control signal GCS, a source control signal SCS, control signals CS, a masking signal MS, and an emission control signal ECS based on the external control signal CTRL. The controller TCP may provide the image data IMD, the source control signal SCS, and the control signals CS to the source driver SDB, may provide the gate control signal GCS and the masking signal MS to the gate driver GDB, and may provide the emission control signal ECS to the emission driver EDB.

The driver CP may further include an image sticking compensator ACP. In an embodiment, the image sticking compensator ACP may be included in the controller TCP. The display panel DP may periodically shift pixels PX which may display a first image FIM based on shift-fixed data SFD generated by the image sticking compensator ACP. The image sticking compensator ACP may convert the image signals RGB and generate shift-fixed data SFD (refer to FIG. 3) to periodically shift the first image FIM while being displayed. For example, the display panel DP may shift the first image FIM from at least one first pixel PX to at least one second pixel PX to reduce pixel burn-in that may be caused by the at least one first pixel PX displaying the first image FIM for too long. According to an embodiment, the display panel DP may periodically shift a first image FIM in a predetermined pattern based on the shift-fixed data SFD generated by the image sticking compensator ACP. The shift-fixed data SFD will be further described later with reference to FIG. 3.

The source driver SDB may receive the source control signal SCS, the control signals CS, and the image data IMD from the controller TCP. The source driver SDB may convert the image data IMD into data signals DS in response to the source control signal SCS and the control signals CS and may respectively output the data signals DS to a plurality of data lines DL1 to DLm. The data signals DS may be analog voltages corresponding to grayscale values of the image data IMD.

The gate driver GDB may receive the gate control signal GCS and the masking signal MS from the controller TCP. The gate driver GDB may generate gate output signals based on the gate control signal GCS. In addition, the gate driver GDB may mask the gate output signal by generating a plurality of scan signals SS1 to SSn in response to the masking signal MS and may respectively output the scan signals SS1 to SSn to a plurality of scan lines SL1 to SLn.

The emission driver EDB may receive the emission control signal ECS from the controller TCP. The emission driver EDB may output emission signals to a plurality of emission lines EML1 to EMLn in response to the emission control signal ECS.

The voltage generator VGT may generate voltages required for an operation of the display panel DP. In an embodiment, the voltage generator VGT may generate a first driving voltage ELVDD, a second driving voltage ELVSS, and an initialization voltage VINT. In an embodiment, the driver CP may control at least one operation of the voltage generator VGT.

The display panel DP may include the scan lines SL1 to SLn, the data lines DL1 to DLm, the emission lines EML1 to EMLn, and the pixels PX. The scan lines SL1 to SLn may extend in the first direction DR1 from the gate driver GDB and may be arranged in the second direction DR2 to be substantially parallel to each other. In an embodiment, the second direction DR2 may be substantially perpendicular to the first direction DR1 The data lines DL1 to DLm may be arranged in the first direction DR1 to be substantially parallel to each other and may extend in the second direction DR2 from the source driver SDB.

Each pixel of the pixels PX may be electrically connected to three corresponding scan lines among the scan lines SL1 to SLn. In addition, each pixel of the pixels PX may be electrically connected to one corresponding emission line of the emission lines EML1 to EMLn and one corresponding data line of the data lines DL1 to DLm. For example, as shown in FIG. 2, a first pixel among the pixels PX may be connected to first, second, and third scan lines SL1, SL2, and SL3, a first emission line EML1, and a first data line DL1.

Each pixel of the pixels PX may include an organic light emitting diode and a pixel circuit controlling a light emitting operation of the organic light emitting diode. The pixel circuit may include a plurality of transistors and a capacitor. Each pixel of the pixels PX may receive the first driving voltage ELVDD, the second driving voltage ELVSS, and the initialization voltage VINT.

Figure 3:
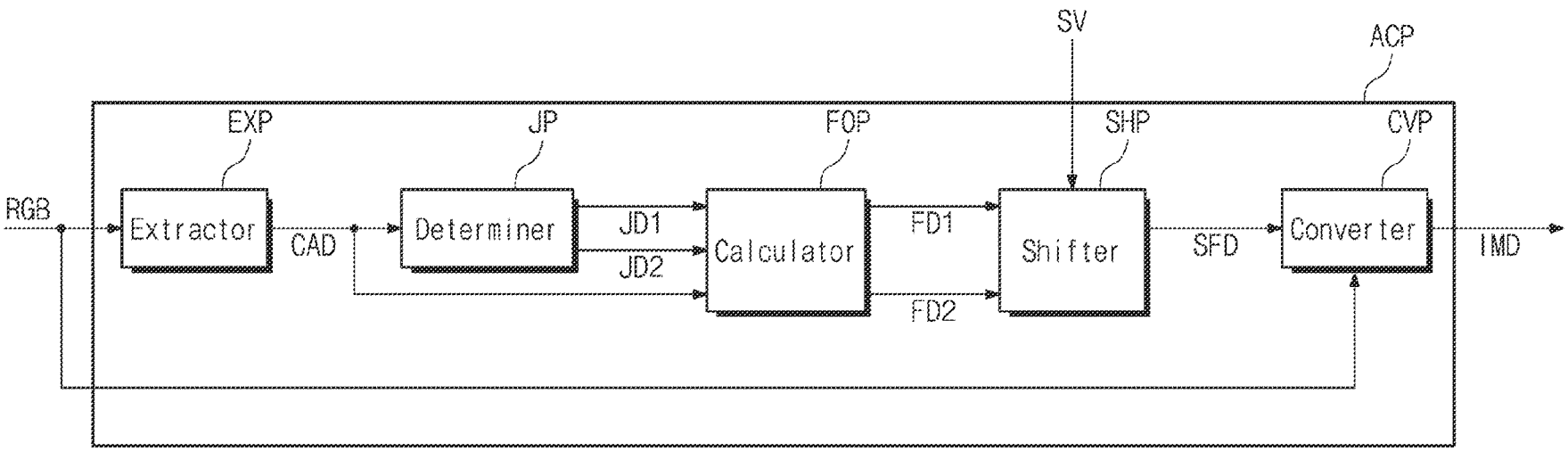
FIG. 3 is a block diagram of an image sticking compensator of the display device according to an embodiment of the inventive concept.
Figure 4A:
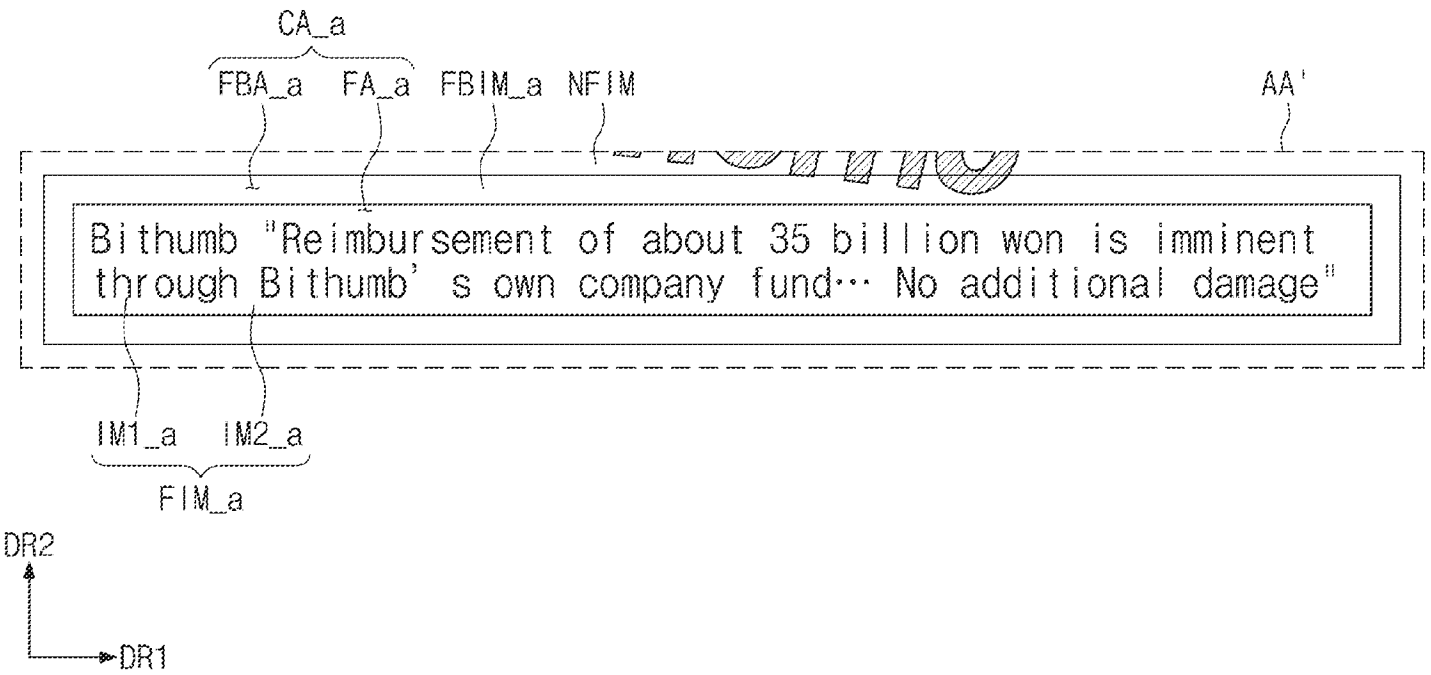
FIG. 4A is an enlarged plan view of an area AA' of FIG. 1.

FIG. 3 is a block diagram of the image sticking compensator ACP according to an embodiment of the inventive concept. FIG. 4A is an enlarged plan view of an area AA' of FIG. 1 and FIG. 4B is an enlarged plan view of an area BB' of FIG. 1.

Referring to FIG. 3, the image sticking compensator ACP may include an extractor EXP, a determiner JP, a calculator FOP, a shifter SHP, and a converter CVP.

Figure 4B:
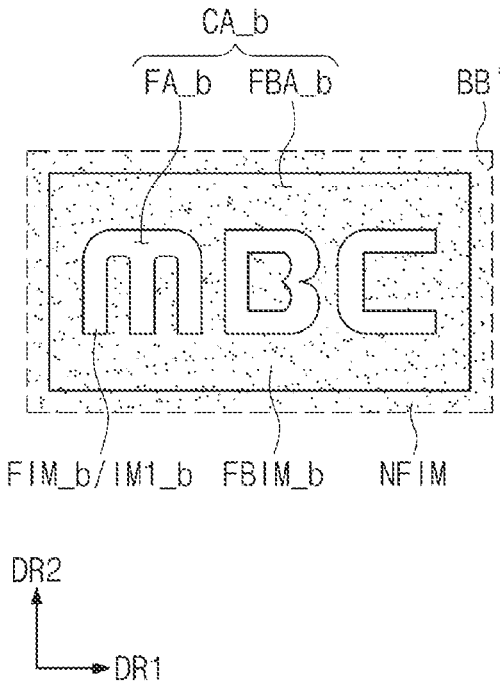
FIG. 4B is an enlarged plan view of an area BB' of FIG. 1.

Referring to FIGS. 3 and 4A to 4B, the extractor EXP may extract compensation area data CAD from the image signals RGB corresponding to first and second compensation areas CA_a and CA_b including pixels PX through which at least a portion of the first image FIM and at least a portion of the second image NFIM may be displayed. The extractor EXP may provide the compensation data CAD to the determiner JP and the calculator FOP. The first and second compensation areas CA_a and CA_b may respectively include first and second fixed areas FA_a and FA_b, including pixels PX through which the first and second fixed images FIM_a and FIM_b may be respectively displayed, and first and second peripheral areas FBA_a and FBA_b, including pixels PX through which first and second peripheral images FBIM_a and FBIM_b may be respectively displayed. The first and second peripheral areas FBA_a and FBA_b may respectively surround the first and second fixed areas FA_a and FA_b, and the first and second peripheral images FBIM_a and FBIM_b may be included in the second image NFIM (refer to FIG. 1). The extractor EXP may analyze the image IM displayed through the display panel DP for a predetermined time and may detect the first and second compensation areas CA_a and CA_b. In addition, the extractor EXP may detect the first and second compensation areas CA_a and CA_b by analyzing the image IM which are repeated at a specific time point. In an embodiment, the extractor EXP may include an artificial intelligence program which may detect the first and second compensation areas CA_a and CA_b via machine learning or deep learning. For example, the deep learning is based on a convolutional neural network model. The extractor EXP may extract the compensation area data CAD with respect to the image IM displayed through the compensation areas CA_a and CA_b.

For example, referring to FIG. 4A, area AA' includes a first compensation area CA_a extracted by the extractor EXP. Hereinafter, for the convenience of explanation, an area in which the first fixed image FIM_a is displayed is referred to as a first fixed area FA_a, and a peripheral image provided around the first fixed image FIM_a, and included in the second image NFIM (refer to FIG. 1) is referred to as a first peripheral image FBIM_a. In addition, an area in which the first peripheral image FBIM_a is displayed is referred to as a first peripheral area FBA_a. In an embodiment, the first fixed area FA_a in which the first fixed image FIM_a may be displayed and the first peripheral area FBA_a in which the first peripheral image FBIM_a may be displayed may be included in the first compensation area CA_a. The first fixed image FIM_a may include a first sub-image IM1_*a* that corresponds to a letter and a second sub-image IM2_*a* that corresponds to a letter background image which may at least partially surround the first sub-image IM1_*a*. In an embodiment, the first fixed image FIM_a may be subtitles, the first sub-image IM1_*a* may be a letter included in the subtitles, and the second sub-image IM2_*a* may be a background portion which may at least partially surround the first sub-image IM1_*a*.

In an embodiment, the first peripheral area FBA_a may be included in the area that includes pixels PX through which at least a portion of the second image NFIM may be displayed. A portion of the second image NFIM may be displayed in the first peripheral area FBA_a. For example, referring to FIGS. 1 and 4A, portions of a letter "m" and a letter "b" included in the second image NFIM are displayed by pixels PX in the first peripheral area FBA_a.

For example, referring to FIG. 4B, area BB' includes a second compensation area CA_b that includes pixels PX of a second fixed area FA_b displaying a second fixed image FIM_b and pixels PX of a second peripheral area FB_a displaying a second peripheral image FBIM_b extracted by the extractor EXP. Hereinafter, for the convenience of explanation, an area in which the second fixed image FIM_b is displayed is referred to as a second fixed area FA_b, and a peripheral image provided around the second fixed image FIM_b and included in the second image NFIM (refer to FIG. 1) is referred to as a second peripheral image FBIM_b. In addition, an area in which the second peripheral image FBIM_b is displayed is referred to as a second peripheral area FBA_b. As an example, the second compensation area CA_b may include the second fixed area FA_b in which the second fixed image FIM_b may be displayed and the second peripheral area FBA_b in which the second peripheral image FBIM_b may be displayed. The second fixed image FIM_b may include a first sub-image IM1_*b* that corresponds to a letter. In an embodiment, the second fixed image FIM_b may be a broadcaster logo that includes only letters, and the first sub-image IM1_*b* may be the same as the second fixed image FIM_b. However, embodiments of the inventive concept are not limited thereto. In an embodiment, the second fixed image FIM_b may be a broadcaster logo that includes a letter and a letter background image, and the second fixed image FIM_b may include a first sub-image corresponding to the letter and a second sub-image corresponding to the letter background image.

In an embodiment, the second peripheral area FBA_b may be included in the area that includes pixels PX through which at least a portion of the second image NFIM may be displayed. At least a portion of the second image NFIM may be displayed by pixels PX in the second peripheral area FBA_b.

Referring back to FIG. 3, the determiner JP may receive the compensation area data CAD from the extractor EXP, may generate a first determination signal JD1 and a second determination signal JD2 based on the compensation area data CAD, and may provide the first determination signal JD1 and/or the second determination signal JD2 to the calculator FOP.

For example, when the compensation area data CAD received by the determiner JP corresponds to a first sub-image that corresponds to the letter and a second sub-image that corresponds to the letter background image, the determiner JP may generate a first determination signal JD1. For example, when the first image FIM includes only the first sub-image that corresponds to the letter, the determiner JP may generate a second determination signal JD2 based on the compensation area data CAD.

For example, referring to FIG. 4A, the first fixed image FIM_a may include a first sub-image IM1_*a* corresponding to a letter portion included in the subtitles and a second sub-image IM2_*a* corresponding to a letter background image surrounding the letter portion. The extractor EXP may extract compensation area data CAD from a data signal RGB corresponding to the first sub-image IM1_*a* and the second sub-image IM2_ and may provide the compensation area data CAD to the determiner JP. The determiner JP may then generate a first determination signal JD1 based on the received compensation area data CAD.

For example, referring to FIG. 4B, the second fixed image FIM_b may include a first sub-image IM1_*b* displayed as the letter portion "MBC" and does not include a sub-image corresponding to a letter background portion. The extractor EXP may extract compensation area data CAD from a data signal RGB corresponding to the first sub-image IM1_*b* and may provide the compensation area data CAD to the determiner JP. The determiner JP may then generate a second determination signal JD2.

In an embodiment, when the first image FIM includes the first fixed image FIM_a and the second fixed image FIM_b, the determiner JP may generate at least one first determination signal JD1 and at least one second determination signal JD2. Referring back to FIG. 3, the calculator FOP may receive the first determination signal JD1 and/or the second determination signal JD2 from the determiner JP, the compensation area data CAD from the extractor EXP, may calculate fixed data based on the received determination signal(s) and the compensation area data CAD, and may provide the fixed data to the shifter SHP. In an embodiment, the fixed data may be calculated to correspond to the first image FIM (refer to FIG. 1) corresponding to the compensation area data CAD. The calculator FOP may identify the first fixed area FA_a and the second fixed area FA_b based on the received compensation area data CAD.

Figure 5A:
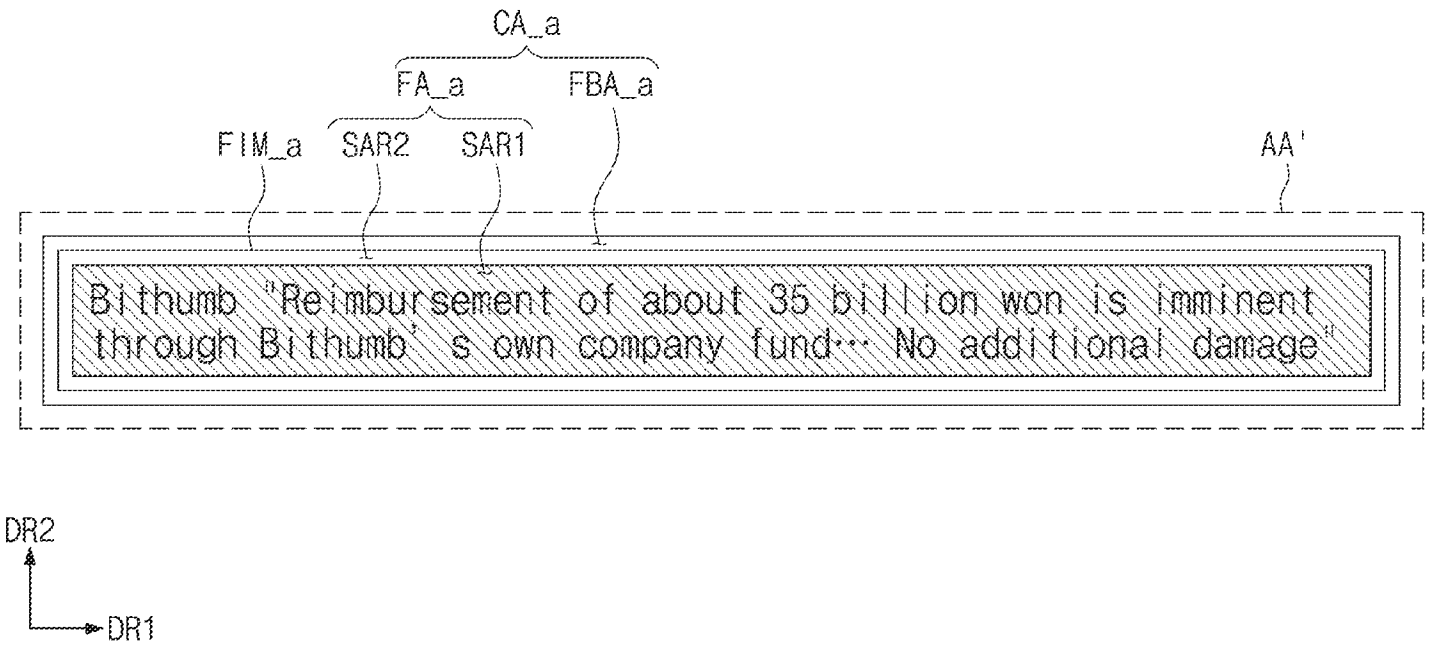
FIG. 5A is an enlarged view of the area AA' during an operation of the display device according to an embodiment of the inventive concept.
Figure 5B:
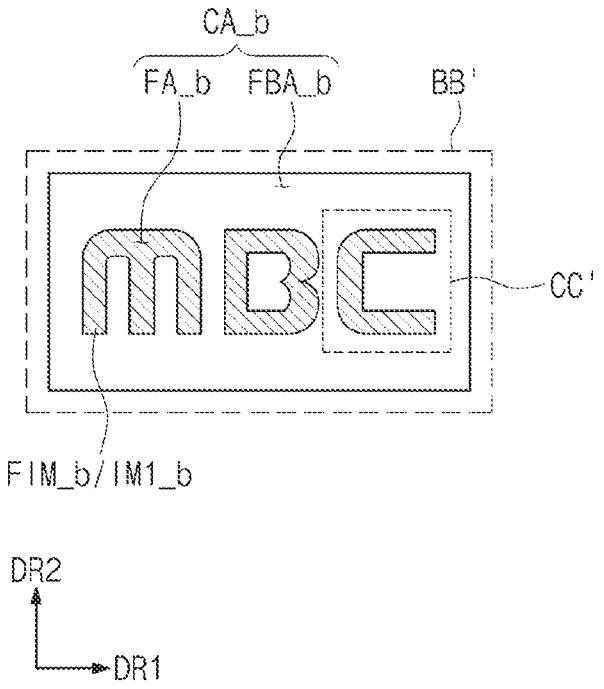
FIG. 5B is an enlarged view of the area BB' during an operation of the display device according to an embodiment of the inventive concept.

FIG. 5A is an enlarged view of the area AA' during an operation of the display device DD according to an embodiment of the inventive concept, and FIG. 5B is an enlarged view of the area BB' during an operation of the display device DD according to an embodiment of the inventive concept.

Referring to FIG. 5A, the first fixed area FA_a may include a first sub-area SAR1 and a second sub-area SAR2 surrounding the first sub-area SAR1. The first sub-area SAR1 may be an area in which the first sub-image IM1_*a* and a portion of the second sub-image IM2_*a* is displayed. The second sub-area SAR2 may be an area in which a remainder of the second sub-image IM2_*a* is displayed.

In an embodiment, when a fixed image includes a first and second sub-image, the calculator FOP may receive the first determination signal JD1 from the determiner JP. For example, referring to FIG. 5A, when the calculator FOP receives the first determination signal JD1 from the determiner JP, the calculator FOP may calculate data corresponding to the first sub-area SAR1 among the compensation area data CAD as the fixed data FD1. The fixed data FD1 calculated when the calculator FOP receives the first determination signal JD1 may be defined as the first fixed data FD1.

In an embodiment, when the calculator FOP calculates the first fixed data FD1, a phenomenon in which the fixed data are calculated to include data with respect to the first fixed image FIM_a and the first peripheral image FBIM_a due to calculation errors to allow a portion of the second image NFIM to be shifted by the image sticking compensator ACP may be prevented. As an example, the calculator FOP may set the first and second sub-areas SAR1 and SAR2 in response to an external control signal. The calculator FOP may set the first sub-area SAR1 to be surrounded by the first fixed area FA_a, with each side of the first sub-area SAR1 spaced apart from each corresponding side of the first fixed area FA_a by n pixels. The calculator FOP may set the second sub-area SAR2 to surround the first sub-area SAR1. For example, n may be equal to two or three. However, embodiments of the inventive concept are not limited thereto, and the calculator FOP may calculate the first sub-area SAR1 such that the first sub-area SAR1 has an area of a certain ratio compared with an area of the first fixed area FA_a.

In an embodiment, when a fixed image includes only a first sub-image, the calculator FOP may receive the second determination signal JD2 from the determiner JP. When the calculator FOP receives the second determination signal JD2 from the determiner JP, the calculator FOP may calculate data corresponding to the first sub-image IM1_*b* among the compensation area data CAD as the fixed data FD2. The fixed data FD2 calculated when the calculator FOP receives the second determination signal JD2 may be defined as the second fixed data FD2.

Referring to FIGS. 3, 4B, and 5B, the calculator FOP may segment the second compensation area CA_b into the second fixed area FA_b in which the second fixed image FIM_b may be displayed and the second peripheral area FBA_b in which the second peripheral image FBIM_b may be displayed. In an embodiment, the calculator FOP may segment the second compensation area CA_b using a binarization method. In an embodiment, the calculator FOP may segment the second compensation area CA_b using Otsu's method. The calculator FOP may detect the second fixed area FA_b through segmentation of the second compensation area CA_b and calculate data corresponding to the second fixed area FA_b as the second fixed data FD2.

In a comparative example, image burn-in in may be avoided by periodically shifting a displayed image from one group of pixels to another. However, this may result in "image sticking", where a portion of an image that has not been targeted for shifting shifts alongside an image that has been targeted for shifting. This image sticking may be caused by calculation errors of a display device. Embodiments of the inventive concept may prevent image burn-in without causing image sticking.

Referring back to FIG. 3, the shifter SHP may receive the fixed data from the calculator FOP and may receive a predetermined set value SV, may generate shift-fixed data SFD based on a shift path, and may provide the shift-fixed data SFD to the converter CVP. The fixed data may be at least one of the first fixed data FD1 and the second fixed data FD2 according to an image included in the first image FIM.

The shifter SHP may generate the shift-fixed data SFD based on the fixed data. As an example, the shifter SHP may receive an external predetermined set value SV from the outside. The external predetermined set value SV may include information about a shift path in which the first image FIM displayed in the display panel DP may be shifted. The shifter SHP may determine the shift path of the first image FIM based on the external predetermined set value SV and may generate the shift-fixed data SFD based on the fixed data.

Hereinafter, for the convenience of explanation, an embodiment in which the first image FIM includes the second fixed image FIM_b and the shifter SHP receives the second fixed data FD2 from the calculator FOP will be described. However, embodiments of the inventive concept are not limited thereto.

FIGS. 6A to 6C and 7A to 7C are enlarged views of an area CC' of FIG. 5B during an operation of the display device DD according to an embodiment of the inventive concept. Referring to FIGS. 3 and 6A to 6C, the external predetermined set value SV applied to the shifter SHP may include information corresponding to a path in which a third fixed image FIM_c, for example, corresponding to a letter "C", that is a portion of the second fixed image FIM_b may be shifted in the first direction DR1. The shifter SHP may generate the shift-fixed data SFD based on the external predetermined set value SV and the second fixed data FD2 such that the third fixed image FIM_c may be shifted in the first direction DR1.

Hereinafter, for the convenience of explanation, an arbitrary area of an area in which the third fixed image FIM_c may be displayed is provided as first reference area, and n pixels may be arranged in the first direction DR1 among the pixels PX included in the first reference area, where n is a positive integer. The third fixed image FIM_c may include a plurality of first reference areas. When images displayed in each of the first reference areas are shifted in the first direction DR1, the entire third fixed image FIM_c may be shifted in the first direction DR1.

Figure 6A:
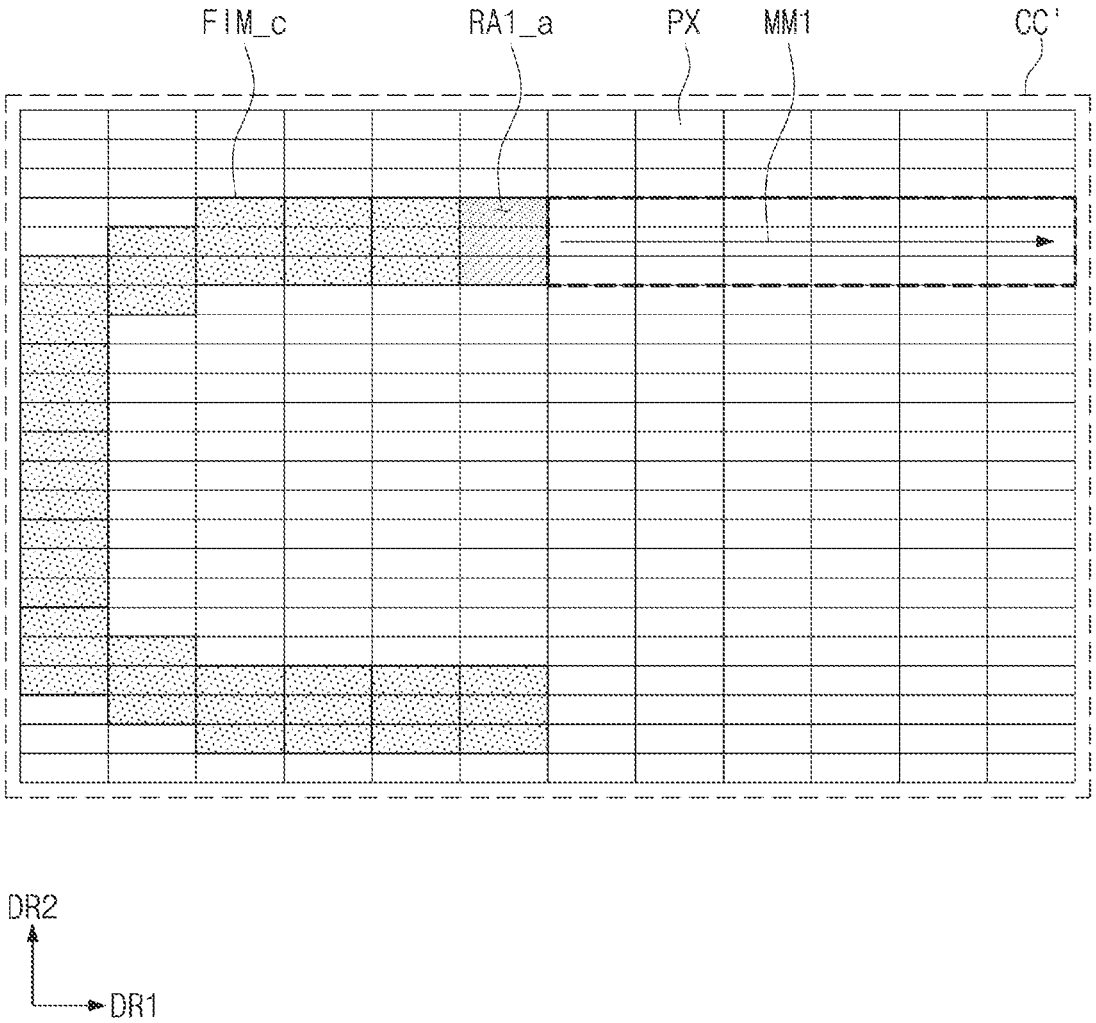
FIGS. 6A to 6C and 7A to 7C are enlarged views of an area CC' of FIG. 5B during an operation of the display device according to an embodiment of the inventive concept.

Referring to FIG. 6A, the first reference area before the shifter SHP shifts the third fixed image FIM_c is referred to as a first sub-reference area RA La. For example, the first sub-reference area RA1_*a* may include one pixel in the first direction DR1.

Figure 6B:
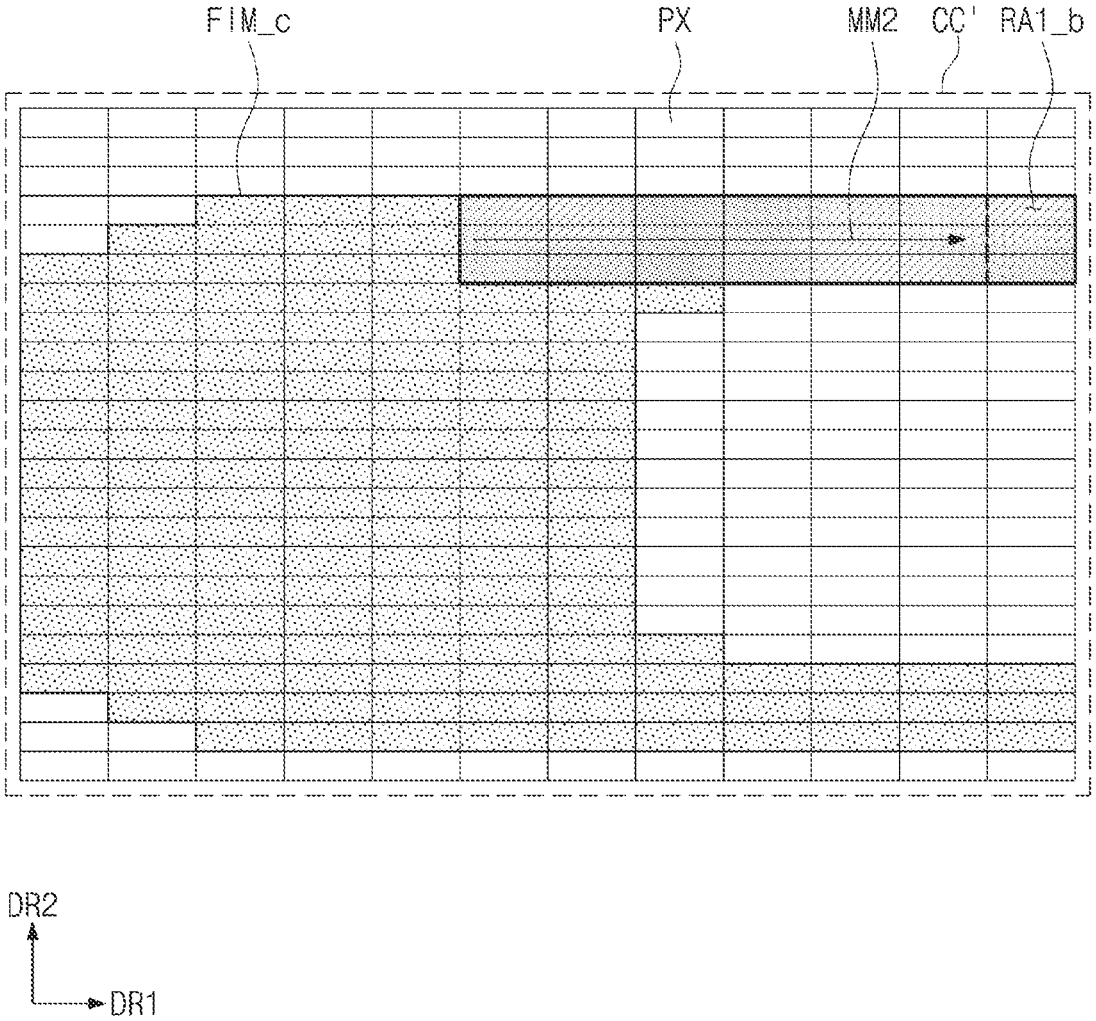

Referring to FIG. 6B, the first reference area after the shifter SHP scales up the second fixed data FD2 to shift the third fixed image FIM_c is referred to as a second sub-reference area RA1_*b*. For example, seven pixels may be arranged along the first direction DR1 in a second sub-reference area RA1_*b*. The shifter SHP may scale up the second fixed data FD2 by a first value MM1 (refer to FIG. 6A) based on the external predetermined set value SV such that an image displayed in the first sub-reference area RA1_*a* among the third fixed image FIM_c is displayed in the second sub-reference area RA1_*b*.

Figure 6C:
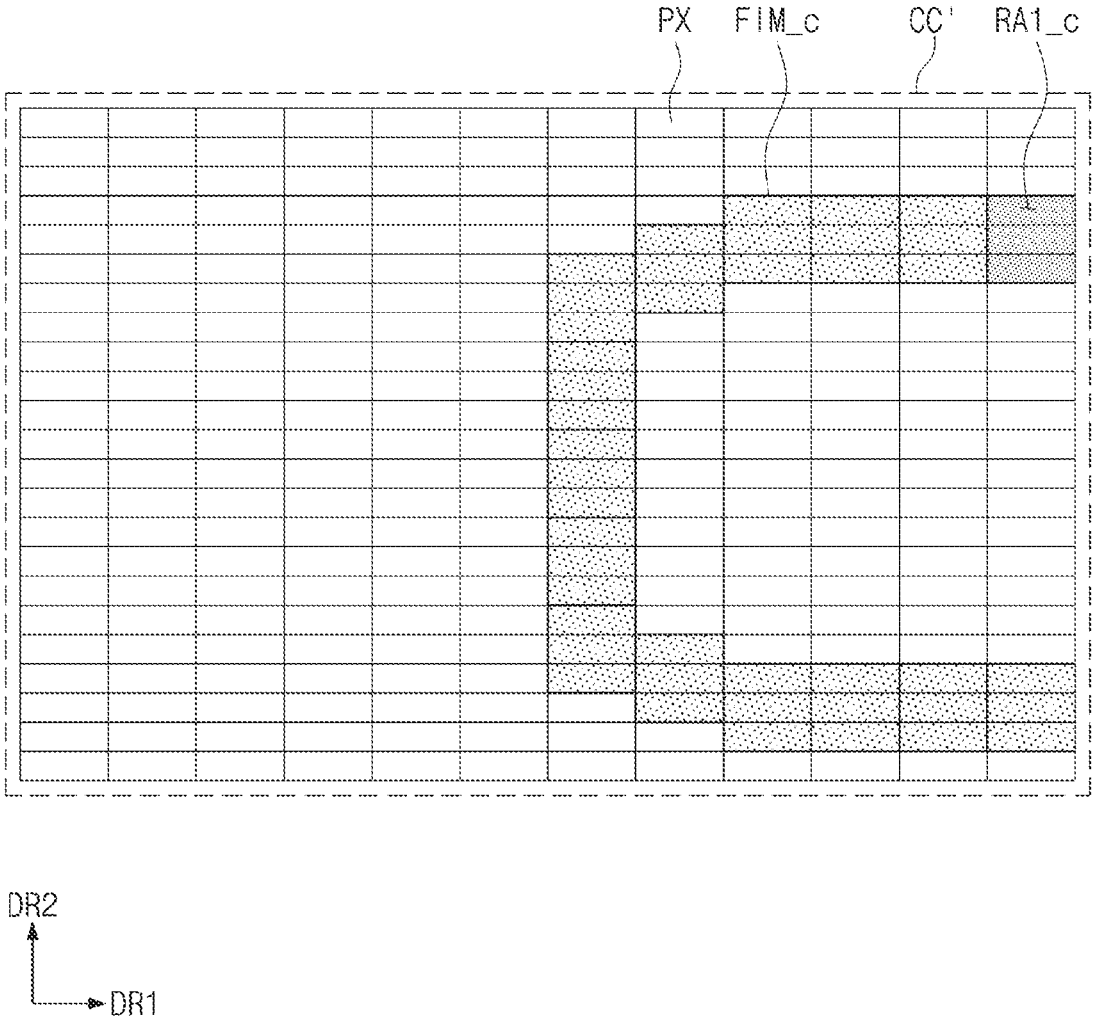

Referring to FIG. 6C, the first reference area after the shifter SHP scales down the scaled-up second fixed data FD2 to shift the third fixed image FIM_c is referred to as a third sub-reference area RA1_*c*. The third sub-reference area RA1_*c* may be shifted in the first direction DR1 by, for example, six pixels when compared with the first sub-reference area RA1_*a* and may include, for example, one pixel in the first direction DR1. The shifter SHP may scale down the scaled-up second fixed data FD2 by a second value MM2 (refer to FIG. 6B) based on the external predetermined set value SV such that an image displayed in the second sub-reference area RA1_*b* among the third fixed image FIM_c is displayed in the third sub-reference area RA1_*c*. Thus, the third fixed image FIM_c corresponding to a portion of the second fixed image FIM_b displayed in the first sub-reference area RA1_*a* may be shifted to be displayed in the third sub-reference area RA1_*c* due to the process of scaling-up and scaling-down the second fixed data FD2 by the shifter SHP.

FIGS. 6A to 6C show the image displayed in the one pixel arranged in the first direction DR1 among the third fixed image FIM_c and shifted in the first direction DR1 by the six pixels. However, embodiments of the inventive concept are not limited thereto. In an embodiment, the shifter SHP may scale up the second fixed data FD2 such that the image displayed in the n pixels arranged in the first direction DR1 included in the third fixed image FIM_c may be displayed in m pixels arranged in the first direction DR1, where m is a positive integer. In addition, the shift-fixed data SFD may be generated by scaling-down the scaled-up second fixed data FD2 such that the image displayed in the m pixels may be displayed in the n pixels after being shifted in the first direction DR1 by m minus n pixels, where m and n are positive integers, and m is greater than n.

Figure 7A:
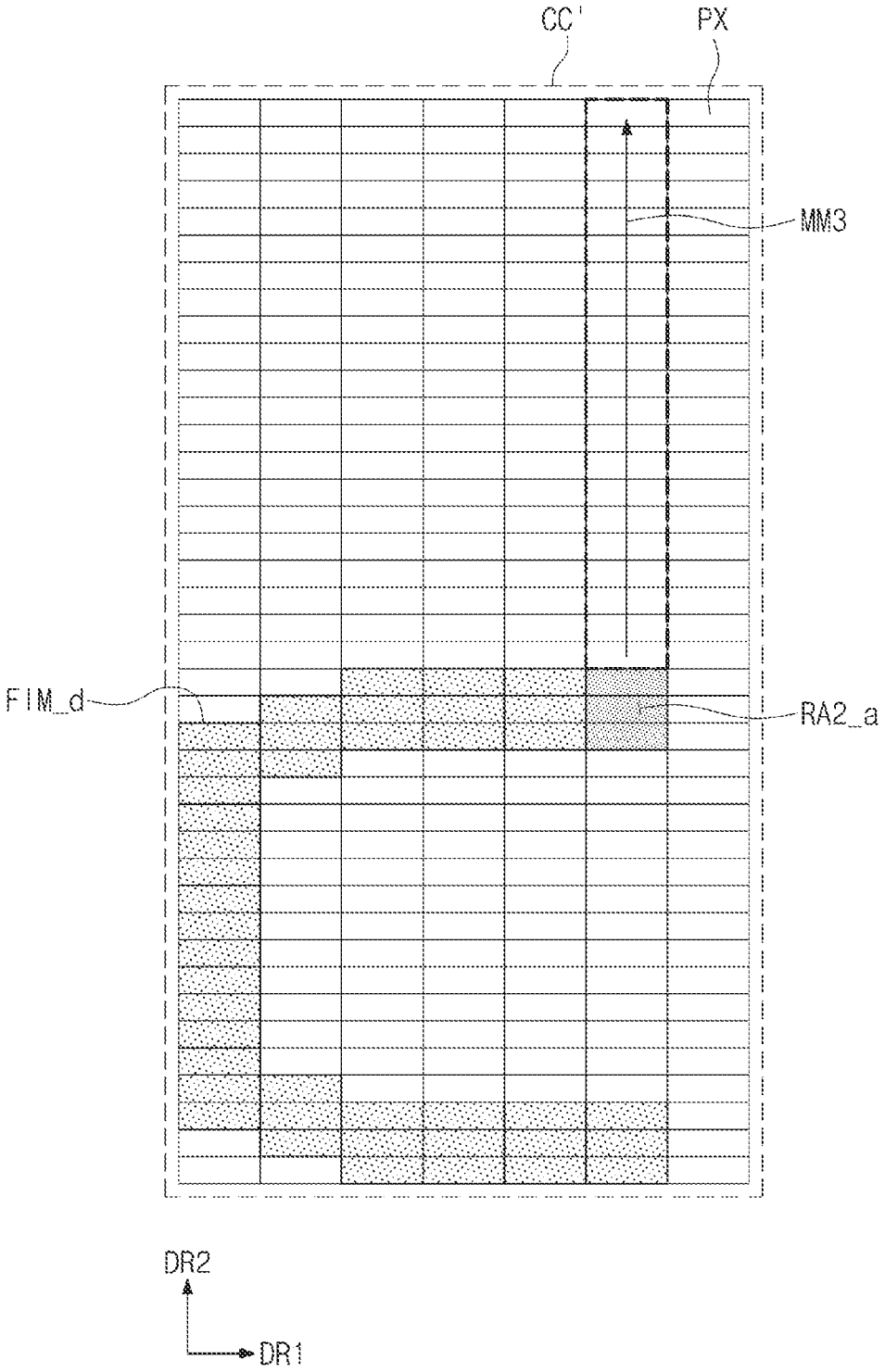
Figure 7B:
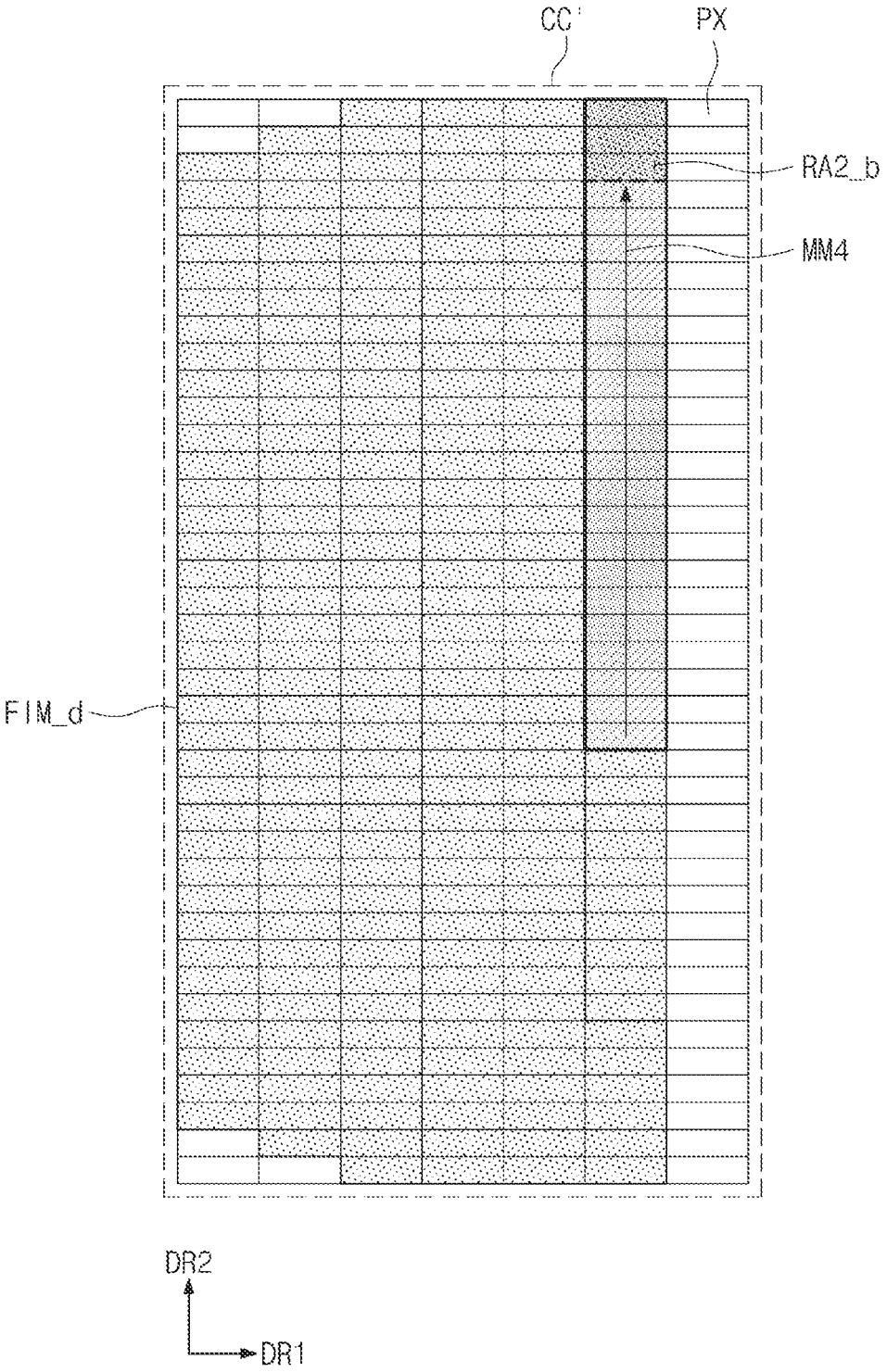
Figure 7C:
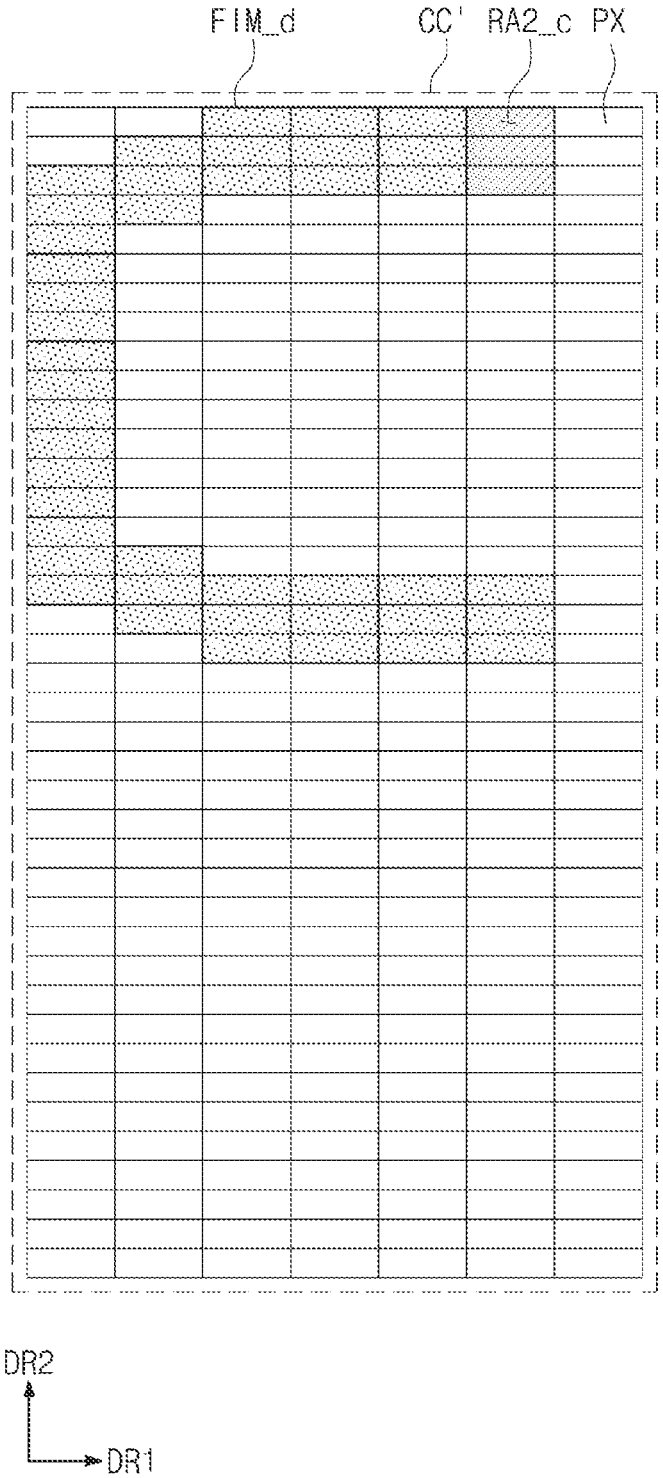

Referring to FIGS. 7A to 7C, the external predetermined set value SV applied to the shifter SHP may further include information corresponding to a path in which a fourth fixed image FIM_d corresponding to, for example, the letter "C", that is a portion of the second fixed image FIM_b may be shifted in the second direction DR2. The shifter SHP may generate the shift-fixed data SFD based on the external predetermined set value SV, the first fixed data FD1, and the second fixed data FD2 such that the fourth fixed image FIM_d may be shifted in the second direction DR2.

Hereinafter, for the convenience of explanation, an arbitrary area of an area in which the fourth fixed image FIM_d may be displayed is referred to as a second reference area, and j pixels may be arranged in the second direction DR2 among the pixels PX included in the second reference area, where j is a positive integer. The fourth fixed image FIM_d may include a plurality of second reference areas. When images displayed in each of the second reference areas are shifted in the second direction DR2, the entire fourth fixed image FIM_d may be shifted in the second direction DR2.

Referring to FIG. 7A, the second reference area before the shifter SHP shifts the fourth fixed image FIM_d is referred to as a fourth sub-reference area RA2_*a*. For example, three pixels are arranged in the fourth sub-reference area RA2_*a* along the second direction DR2.

Referring to FIG. 7B, the second reference area after the shifter SHP scales up the first fixed data FD1 and the second fixed data FD2 to shift the fourth fixed image FIM_d is referred to as a fifth sub-reference area RA2_*b*. For example, twenty-four pixels may be arranged in the fifth sub-reference area RA2_*b* along the second direction DR2. The shifter SHP may scale up the first fixed data FD1 and the second fixed data FD2 by a third value MM3 (refer to FIG. 7A) based on the external predetermined set value SV such that an image displayed in the fourth sub-reference area RA2_*a* among the fourth fixed image FIM_d may be displayed in the fifth sub-reference area RA2_*b*.

Referring to FIG. 7C, the second reference area after the shifter SHP scales down the scaled-up first fixed data FD1 and the scaled-up second fixed data FD2 to shift the fourth fixed image FIM_d is referred to as a sixth sub-reference area RA2_*c*. For example, the sixth sub-reference area RA2_*c* may be shifted in the second direction DR2 by twenty-one pixels when compared with the fourth sub-reference area RA2_*a* and may include three pixels in the second direction DR2. The shifter SHP may scale down the scaled-up first fixed data FD1 and the scaled-up second fixed data FD2 by a fourth value MM4 (refer to FIG. 7B) based on the external predetermined set value SV such that an image displayed in the fifth sub-reference area RA2_*b* among the fourth fixed image FIM_d may be displayed in the sixth sub-reference area RA2_*c*.

The fourth fixed image FIM_d corresponding to a portion of the second fixed image FIM_b displayed in the fourth sub-reference area RA2_*a* may be shifted to be displayed in the sixth sub-reference area RA2_*c* due to the process of scaling-up and scaling-down the first fixed data FD1 and the second fixed data FD2 by the shifter SHP.

FIGS. 7A to 7C show the image displayed in the three pixels arranged in the second direction DR2 among the fourth fixed image FIM_d and shifted in the second direction DR2 by the twenty-one pixels. However, embodiments of the inventive concept are not limited thereto. In an embodiment, the shifter SHP may scale up the first fixed data FD1 and the second fixed data FD2 such that the image displayed in j pixels arranged in the second direction DR2 among the fourth fixed image FIM_d may be displayed in k pixels arranged in the second direction DR2. In addition, the shift-fixed data SFD may be generated by scaling-down the scaled-up first fixed data FD1 and the scaled-up second fixed data FD2 such that the image displayed in the k pixels may be displayed in the j pixels after being shifted in the second direction DR2 by k minus j pixels, where j and k are positive integers and k is greater than j.

Referring back to FIG. 3, the converter CVP may receive the shift-fixed data SFD from the shifter SHP, may generate the image data IMD by converting a data format of the shift-fixed data SFD to a data format appropriate to an interface between the converter CVP and the source driver SDB, and may provide the image data IMD to the source driver SDB.

The source driver SDB may generate the data signals DS based on the received image data IMD by converting the received image data IMD to the data signals DS in response to receiving the source control signal SCS and the control signals CS from the controller TCP.

Figure 8:
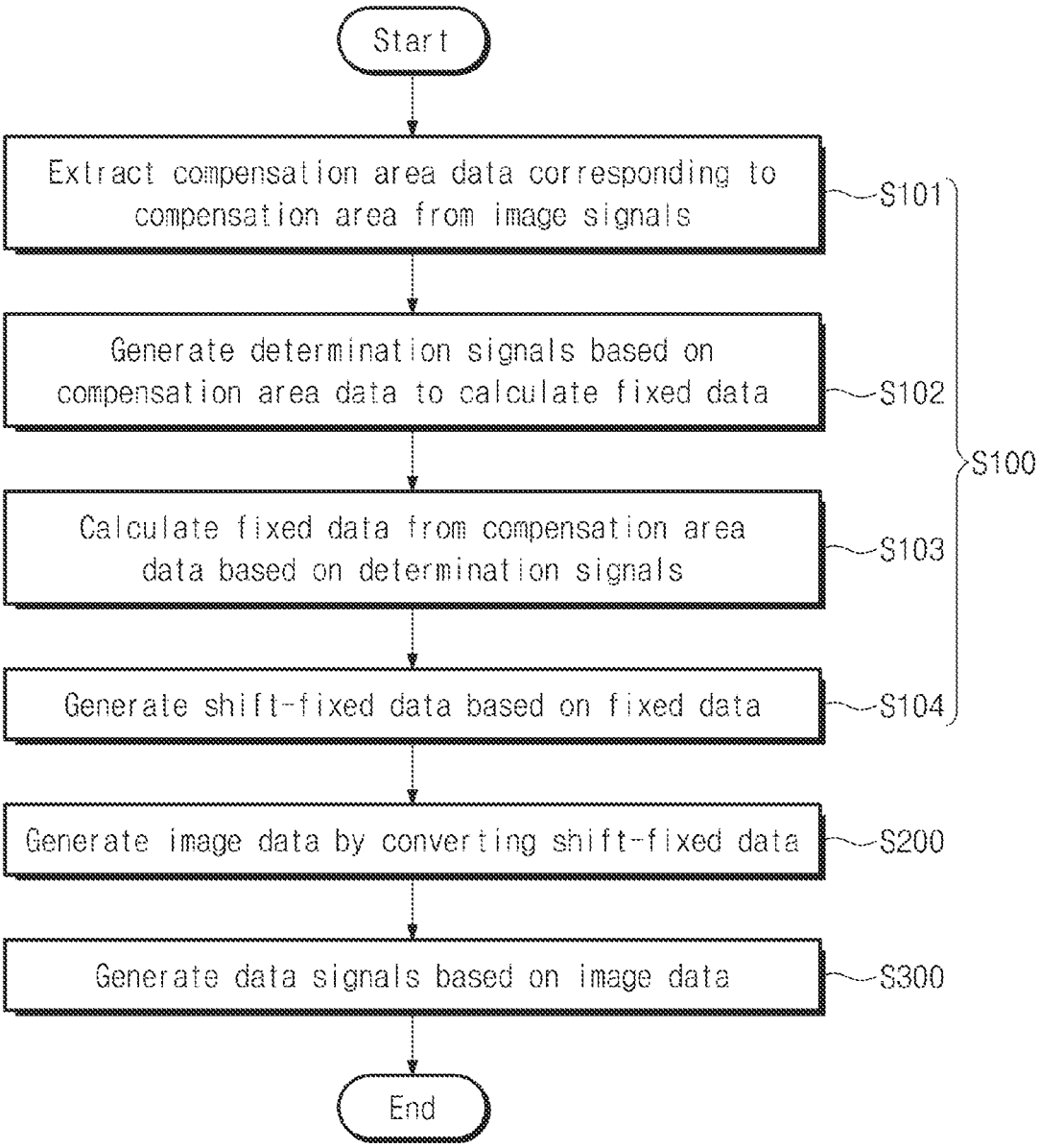
FIG. 8 is a flowchart of a method of driving the display device according to an embodiment of the inventive concept.

FIG. 8 is a flowchart of a method of driving a display device DD according to an embodiment of the inventive concept.

Referring to FIGS. 1 to 3 and 8, the display device DD may include a display panel DP which may include a plurality of pixels PX. The display device DD may further include a driver CP. The driver CP may include a source driver SDB and a controller TCP. The controller TCP may include a converter CVP.

The driver CP may generate shift-fixed data SFD based on external image signals RGB such that the first image FIM is periodically shifted while being displayed (S100). The shift-fixed data SFD may correspond to a desired shift in pixels PX disposed in the display panel DP which may display a first image FIM.

In an embodiment, the controller TCP may include an image sticking compensator ACP, and the image sticking compensator ACP may include an extractor EXP. The extractor EXP may extract compensation area data CAD from the image signal RGB corresponding to at least one compensation area to generate the shift-fixed data SFD (S101).

In an embodiment, the image sticking compensator ACP may further include a determiner JP. The determiner JP may generate a first determination signal JD1 or a second determination signal JD2 in response to receiving the compensation area data CAD from the extractor EXP (S102).

In an embodiment, the image sticking compensator ACP may further include a calculator FOP. The calculator FOP may calculate the first and the second fixed data FD1 and FD2 in response to receiving the first determination signal JD1 and/or the second determination signal JD2 from the determiner JP and the compensation area data CAD from the extractor (S103).

In an embodiment, the image sticking compensator ACP may further include a shifter SHP, and generating the shift-fixed data SFD may include generating the shift-fixed data SFD by the shifter SHP in response to receiving an external predetermined set value SV and at least one of the first fixed data FD1 and the second fixed data FD2 (S104).

The converter CVP may receive the shift-fixed data SFD and may generate the image data IMD by converting the shift-fixed data SFD (S200). In an embodiment, the converter CVP may be included in the image sticking compensator ACP.

The source driver SDB may receive the image data IMD from the converter CVP and may generate data signals DS based on the image data IMD (S300) In detail, the source driver SDB included in the driver CP may convert the image data IMD to the data signals DS in response to the source control signal SCS and the control signals CS.

Figure 9:
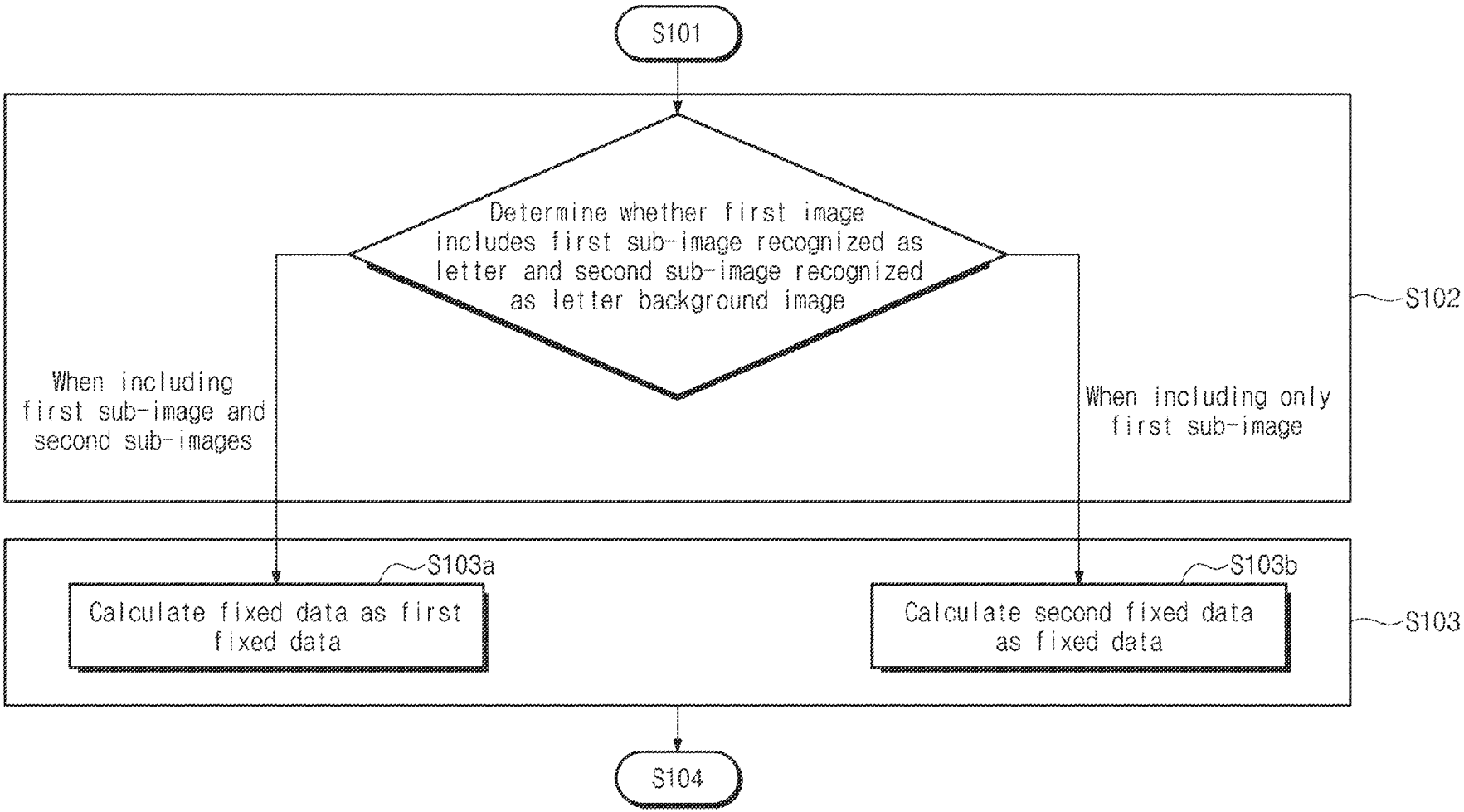
FIG. 9 is a flowchart of a method of generating a determination signal and a method of calculating first and second fixed data.

FIG. 9 is a flowchart of a method of generating the determination signal and a method of calculating the first and second fixed data.

Referring to FIGS. 3 and 9, according to an embodiment of the inventive concept, the determiner JP may determine whether the first image FIM (refer to FIG. 1) includes only an image corresponding to a letter or includes the image corresponding to the letter and an image corresponding to a letter background image to generate the first determination signal JD1 or the second determination signal JD2, respectively (S102).

For example, referring to FIG. 4A, the determiner JP may generate the first determination signal JD1 when the first fixed image FIM_a includes the first sub-image IM1_*a* that corresponds to a letter and the second sub-image IM2_*a* that corresponds to a letter background image.

For example, referring to FIG. 4B, the determiner JP may generate the second determination signal JD2 when the second fixed image FIM_b includes only the first sub-image IM1_*b* that corresponds to a letter.

Referring to FIGS. 5A and 9, the calculator FOP may calculate the fixed data as the first fixed data FD1 from the compensation area data CAD when receiving the first determination signal JD1 (S103*a*). The calculator FOP may calculate the fixed data as the second fixed data FD2 from the compensation area data CAD when receiving the second determination signal JD2 (S103*b*).

Figure 10:
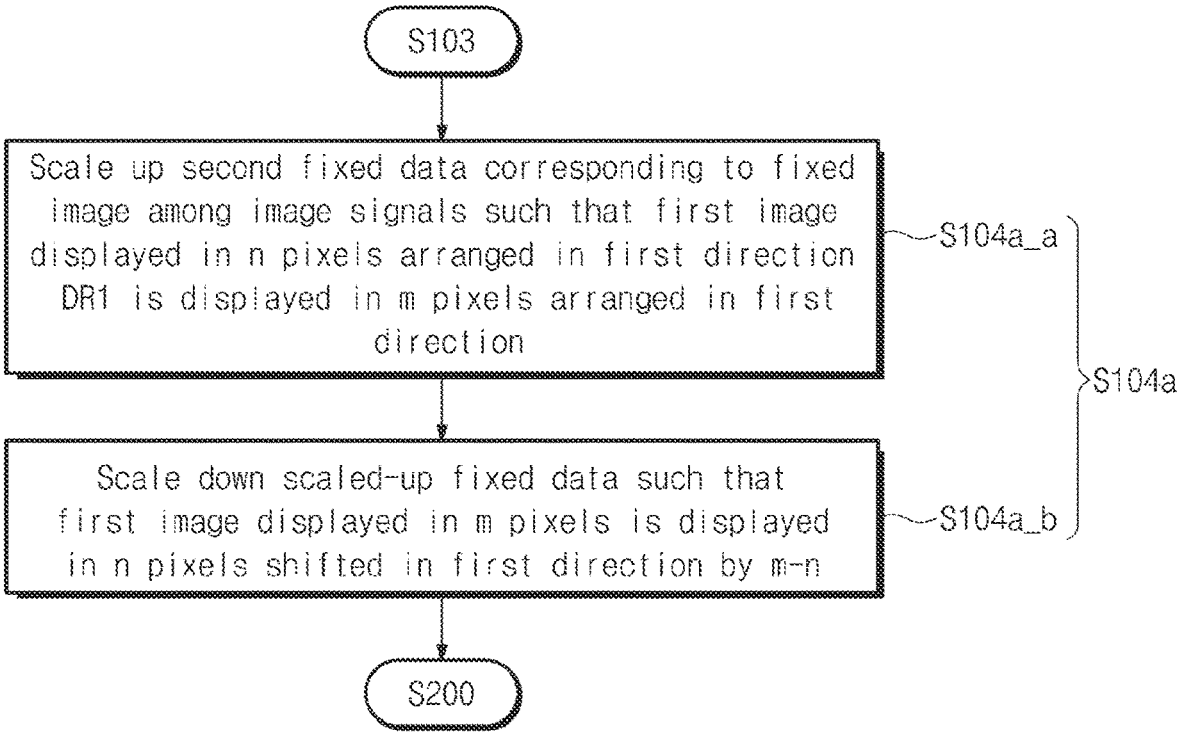
FIGS. 10 and 11 are flowcharts of a method of generating shift-fixed data based on fixed data.
Figure 11:
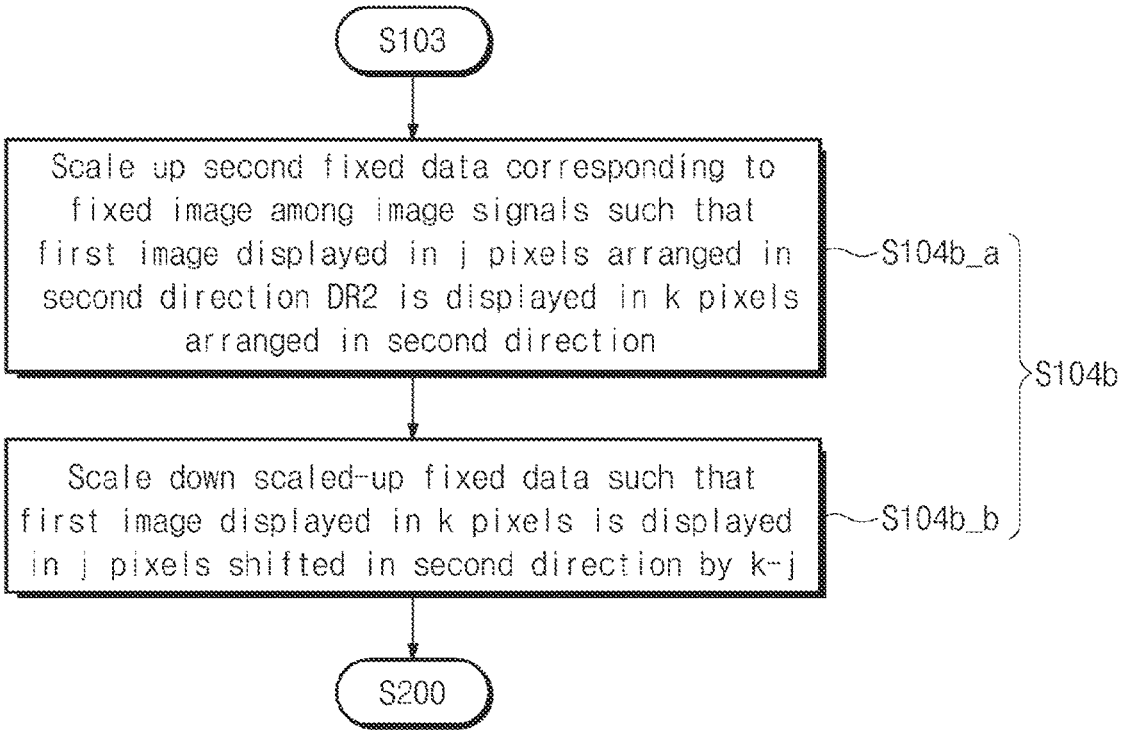

FIGS. 10 and 11 are flowcharts of a method of generating the shift-fixed data based on the fixed data.

Referring to FIGS. 3 and 10, the shifter SHP may receive the external predetermined set value SV and may generate the shift-fixed data SFD based on the external predetermined set value SV, the first fixed data FD1, and the second fixed data FD2. The external predetermined set value SV may include information corresponding to a shift path of the first image FIM, and the shift path may correspond to at least one of a first direction DR1 and a second direction DR2.

The generating of the shift-fixed data SFD based on the first fixed data FD1 and the second fixed data FD2 may include generating the shift-fixed data SFD based on the first fixed data FD1 and the second fixed data FD2 such that the first image FIM may be shifted in the first direction DR1 (S104*a*).

The generating of the shift-fixed data SFD to shift the first image FIM in the first direction DR1 may include scaling up the first fixed data FD1 and the second fixed data FD2 such that a first image FIM displayed in n pixels PX arranged in the first direction DR1 is displayed in m pixels PX arranged in the first direction DR1 (S104*a_a*). In addition, the generating of the shift-fixed data SFD to shift the first image FIM in the first direction DR1 may further include scaling down the scaled-up first fixed data FD1 and the scaled-up second fixed data FD2 such that the first image FIM displayed in the m pixels is displayed in the n pixels shifted in the first direction DR1 by m minus n pixels (S104*a_b*).

Referring to FIGS. 3 and 11, the generating of the shift-fixed data SFD based on the first fixed data FD1 and the second fixed data FD2 may include generating the shift-fixed data SFD based on the first fixed data FD1 and the second fixed data FD2 such that the first image FIM may be shifted in the second direction DR2 (S104*b*).

The generating of the shift-fixed data SFD to shift the first image FIM in the second direction DR2 may include scaling up the first fixed data FD1 and the second fixed data FD1 and FD2 such that the first image FIM displayed in j pixels arranged in the second direction DR2 is displayed in k pixels arranged in the second direction DR2 (S104*b_a*). In addition, the generating of the shift-fixed data SFD to shift the first image FIM in the second direction DR2 may further include scaling down the scaled-up first fixed data FD1 and the scaled-up second fixed data FD2 such that the first image FIM displayed in the k pixels is displayed in the j pixels shifted in the second direction DR2 by k minus j pixels (S104*b_b*).

While the inventive concept has been particularly shown and described with reference to embodiments thereof, it will be understood by one of ordinary skill in the art that variations in form and detail may be made therein without departing from the spirit and scope of the inventive concept as defined by the following claims.

What is claimed is:

1. A display device comprising:

a display panel comprising a compensation area, the compensation area comprising a first area configured to display a first image and a second area configured to display a second image, wherein the second area at least partially surrounds the first area;

a driver configured to receive an external image signal and to transmit a data signal to the display panel; and an image sticking compensator circuit configured to convert the external image signal such that the first image is shifted while being displayed, the image sticking compensator circuit comprising:

an extractor circuit configured to detect pixels included in the compensation area and to extract compensation area data corresponding to the pixels from the external image signal;

a determiner circuit configured to generate a first determination signal and a second determination signal based on the compensation area data, the first determination signal being generated when the first image comprises a first sub-image corresponding to a letter and a second sub-image corresponding to a letter background image, and the second determination signal being generated when the first image consists of the first sub-image;

a calculator circuit configured to calculate first fixed data and second fixed data based on the first determination signal and the second determination signal, respectively; and a shifter circuit configured to generate shift-fixed data capable of shifting only the first sub-image based on the first fixed data or the second fixed data, wherein the image sticking compensator circuit is included in the driver, wherein the calculator circuit is further configured to calculate the first fixed data in response to receiving the first determination signal and to calculate the second fixed data in response to receiving the second determination signal, wherein the first fixed data comprises data corresponding to the first sub-image and data corresponding to the second sub-image, and wherein the second fixed data comprises the data corresponding to the first sub-image.

2. The display device of claim 1, wherein the shifter circuit is further configured to:

receive a set value comprising information corresponding to a shift path of the first image; and generate the shift-fixed data based on the set value and the first fixed data or the second fixed data.

3. The display device of claim 2, wherein:

the display panel further comprises a plurality of pixels;

the shift path comprises a first direction; and the shifter circuit is further configured to generate the shift-fixed data based on the first fixed data or the second fixed data to shift the first image in the first direction by scaling-up the first fixed data or the second fixed data such that a first portion of the first image displayed in an nth pixel of the plurality of pixels is simultaneously displayed in each of a row of m pixels arranged in the first direction including the nth pixel and then scaling-down the scaled-up first fixed data or second fixed data such that the first portion of the first image is displayed only in an mth pixel of the row of m pixels, where n and m are positive integers and m is greater than n.

4. The display device of claim 3, wherein:

the shift path further comprises a second direction crossing the first direction; and the shifter circuit is further configured to generate the shift-fixed data based on the first fixed data or the second fixed data to shift the first image in the second direction by scaling-up the first fixed data or the second fixed data such that a second portion of the first image displayed in a jth pixel of the plurality of pixels is simultaneously displayed in each of a column of k pixels arranged in the second direction including the jth pixel and then scaling-down the scaled-up first fixed data or second fixed data such that the second portion of the first image is displayed only in a kth pixel of the column of k pixels, where j and k are positive integers and k is greater than j.

5. The display device of claim 1, wherein:

the image sticking compensator circuit further comprises a converter circuit configured to receive the shift-fixed data from the shifter circuit and to generate image data by converting the shift-fixed data; and the driver is further configured to generate a data signal based on the image data.

6. The display device of claim 5, wherein the driver further comprises:

a controller configured to receive the image data and an external control signal;

a source driver configured to receive the image data and the external control signal from the controller and to transmit the data signal to the display panel; and a gate driver configured to receive a control signal from the controller and to transmit a scan signal to the display panel, wherein the image sticking compensator circuit is included in the controller.

7. A method of driving a display device, the method comprising:

generating shift-fixed data such that pixels corresponding to a first image are shifted and pixels corresponding to a second image are maintained while being displayed in a compensation area of a display panel included in the display device, the generating of the shift-fixed data comprising:

receiving, by a driver included in the display device, an external image signal;

extracting compensation area data corresponding to pixels of the compensation area from the external image signal;

generating a first determination signal and a second determination signal based on the compensation area data;

calculating first fixed data and second fixed data from the first determination signal and the second determination signal, respectively; and generating the shift-fixed data capable of shifting only the first sub-image based on the first fixed data or the second fixed data, wherein the compensation area comprises a first area in which the first image is displayed and a second area at least partially surrounding the first area in which a second image is displayed, wherein the first determination signal is generated when the first image comprises a first sub-image corresponding to a letter and a second sub-image corresponding to a letter background image, and wherein the second determination signal is generated when the first image consists of the first sub-image, wherein the first fixed data is calculated in response to receiving the first determination signal;

wherein the second fixed data is calculated in response to receiving the second determination signal, wherein the first fixed data comprises data corresponding to the first sub-image and data corresponding to the second sub-image, and wherein the second fixed data comprises the data corresponding to the first sub-image.

8. The method of claim 7, wherein the generating of the shift-fixed data comprises:

receiving a set value; and generating the shift-fixed data based on the set value and the first fixed data or the second fixed data, wherein the set value comprises information corresponding to a shift path of the first image.

9. The method of claim 8, wherein:

the display panel comprises a plurality of pixels;

the shift path comprises a first direction; and the generating of the shift-fixed data comprises generating the shift-fixed data based on the first fixed data or the second fixed data to shift the first image in the first direction by scaling up the first fixed data or the second fixed data such that a first portion of the first image displayed in an nth pixel of the plurality of pixels is simultaneously displayed in each of a row of m pixels arranged in the first direction including the nth pixel and then scaling down the scaled-up first fixed data or second fixed data such that the first portion of the first image is displayed only in an mth pixel of the row of m pixels, where n and m are positive integers and m is greater than n.

10. The method of claim 9, wherein:

the shift path further comprises a second direction crossing the first direction; and the generating of the shift-fixed data further comprises generating the shift-fixed data based on the first fixed data or the second fixed data to shift the first image in the second direction by scaling up the first fixed data or the second fixed data such that a second portion of the first image displayed in a jth pixel of the plurality of pixels is simultaneously displayed in each of a column of k pixels arranged in the second direction including the jth pixel and then scaling down the scaled-up first fixed data or second fixed data such that the second portion of the first image is displayed only in a kth pixel of the column of k pixels, where j and k are positive integers and k is greater than j.

11. The method of claim 7, further comprising:

generating image data by converting the shift-fixed data;

generating a data signal based on the image data; and transmitting the data signal by the driver to the display panel.

12. The method of claim 11, wherein the driver comprises:

a controller configured to receive the image data and an external control signal;

a source driver configured to receive the image data and the external control signal from the controller and to transmit the data signal to the display panel; and a gate driver configured to receive the control signal from the controller and to transmit a scan signal to the display panel, wherein the generating the shift-fixed data is performed by the controller.

* * * * *